US007967548B2

(12) United States Patent
Stroh

(10) Patent No.: US 7,967,548 B2
(45) Date of Patent: Jun. 28, 2011

(54) MATERIAL HANDLING SYSTEM

(75) Inventor: Brad Stroh, Waterloo, IA (US)

(73) Assignee: A-Line EDS, Inc., Waterloo, IA (US)

( * ) Notice: Subject to any disclaimer, the term of this patent is extended or adjusted under 35 U.S.C. 154(b) by 288 days.

(21) Appl. No.: 11/818,230

(22) Filed: Jun. 13, 2007

(65) Prior Publication Data

US 2008/0310942 A1 Dec. 18, 2008

(51) Int. Cl.
*B66C 1/00* (2006.01)

(52) U.S. Cl. ..... 414/729; 294/104; 29/700

(58) Field of Classification Search ..... 414/729; 294/104; 29/700, 711, DIG. 47
See application file for complete search history.

(56) References Cited

U.S. PATENT DOCUMENTS 3,097,011 A * 7/1963 Foster ..... 294/104
4,162,804 A * 7/1979 Davies ..... 294/101
4,187,711 A * 2/1980 Lavochkin et al. ..... 72/256
4,969,780 A * 11/1990 Hermsted ..... 408/1 R
6,086,126 A * 7/2000 Krauss ..... 294/104
7,329,082 B2 * 2/2008 Warren ..... 414/723

* cited by examiner

*Primary Examiner* — Donald Underwood
(74) *Attorney, Agent, or Firm* — Brett Trout

(57) ABSTRACT

A material handling system for engaging and transporting material. The material handling system includes a mouth and a hydraulic actuator for pivoting a tooth within the mouth. Once a material has been positioned within the mouth, the hydraulic piston actuates the tooth to secure the material within the mouth. The tooth is preferably configured and oriented to move into tighter engagement with the material as gravity or other forces attempt to remove the material from the mouth. The hydraulic piston allows an operator to release the tooth whenever desired. The material handling system includes a vehicle mounted boom coupled to the mouth so that material engaged by the mouth may be transported to another desired location.

15 Claims, 5 Drawing Sheets

72
75
85
80
64
63
62

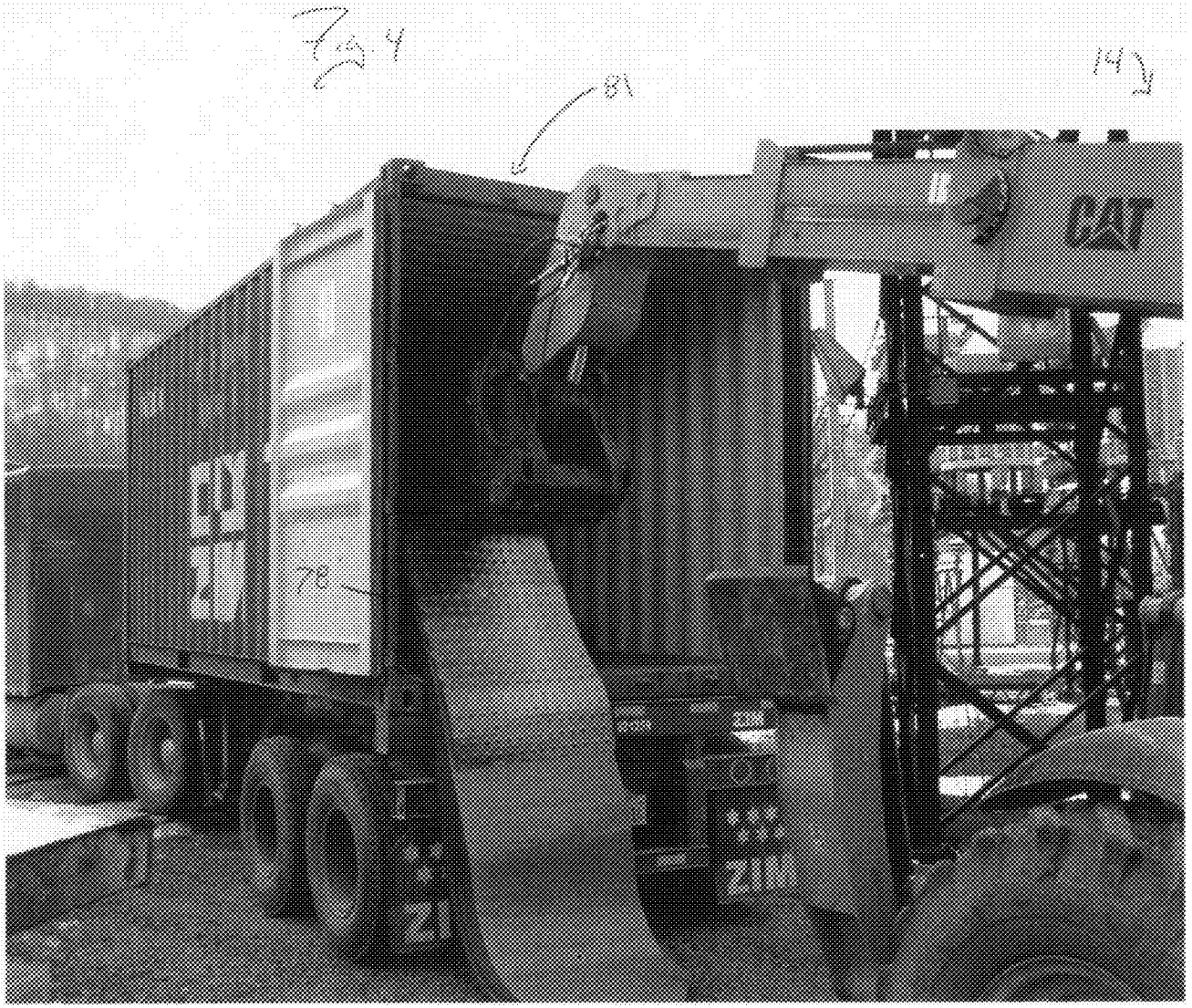
14
6
14
22

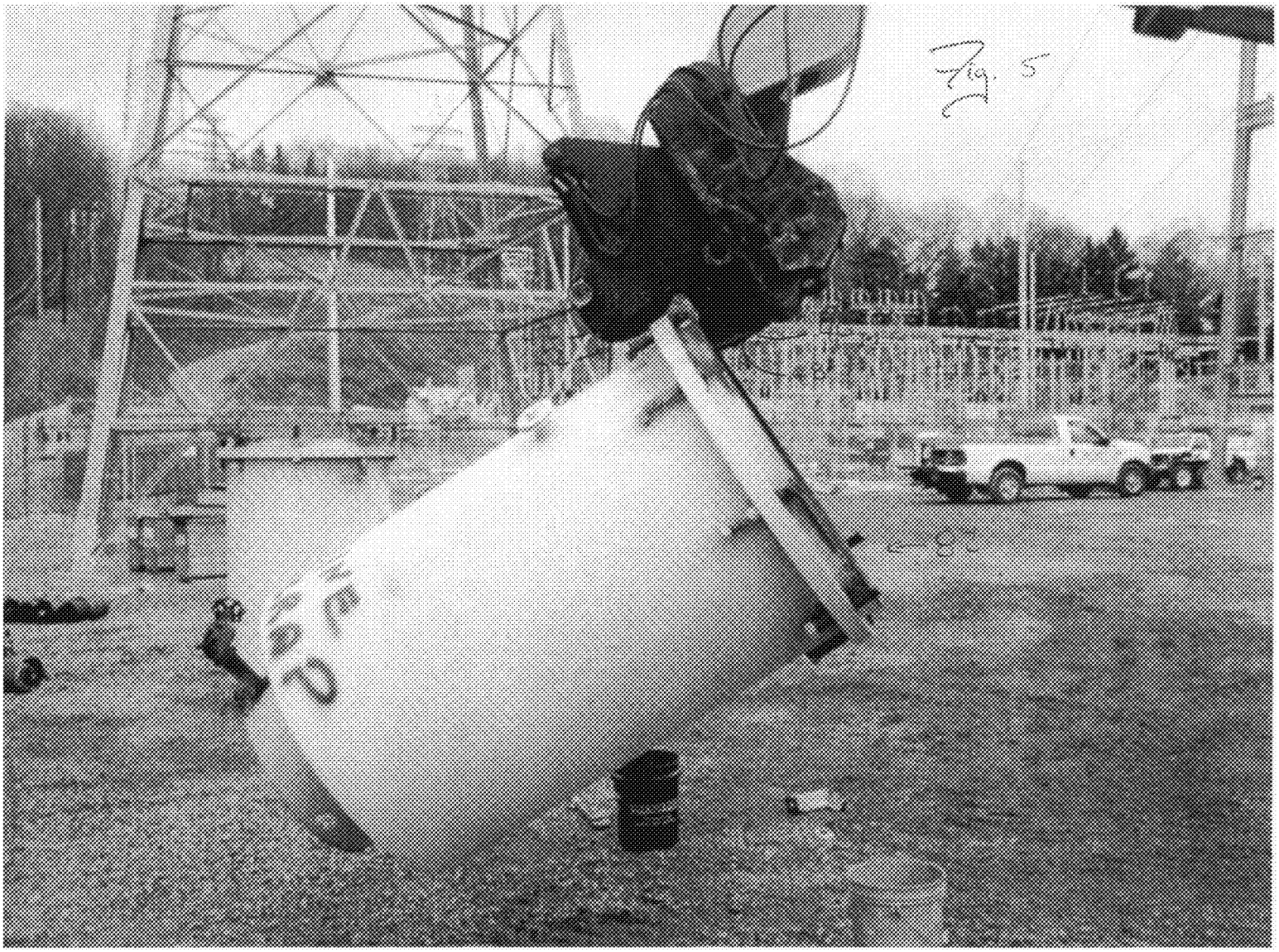

MATERIAL HANDLING SYSTEM

BACKGROUND OF THE INVENTION

1. Field of the Invention

The present invention relates in general to a material handling system and, more particularly, to a mechanically actuated plate clamp.

2. Description of the Prior Art

When recycling large transformers, especially transformers of one megavolt-ampere (MVA) or greater, it is desirable to preserve the metallic laminations from the transformer's core. Due to the unique construction of the laminations, it is desirable to remove the laminations and place them on a transport vehicle with a minimum of damage3 so that the laminations can be reused or cut as desired to use in smaller transformer applications.

Prior art material handling machines can be used to move laminations. Drawbacks associated with using prior art material handling machines to move laminations include damage to the laminations from gripping too tightly or damage from dropping laminations gripped too loosely. It would, therefore, be desirable to provide a system for removing and handling laminations without damaging them.

It is known in the art to provide a plate clamp for the movement of large flat pieces of material. Prior art plate clamps include two parallel plates divided by a spacer and forming a mouth. A curved tooth is journaled between the plates for movement within the mouth. When a large plate is positioned in the mouth, the tooth moves into contact with the plate. As the plate clamp is moved away from the plate, such as when attempting to lift the plate, the movement of the plate out of the mouth of the plate clamp causes the tooth to pivot into further engagement with the plate.

The curved tooth, therefore, pins the plate between the lower law of the parallel plates and the tooth. Additional movement of the plate in a direction out of the mouth further pinches the plate between the tooth and the lower jaw. In the prior art, the plate clamp is coupled to ropes or cables and lifted upward to move a plate to a desired location. When it is desired to release the plate clamp, the plate clamp is moved toward the plate to move the plate further into the mouth of the plate clamp. As the plate moves further into the mouth of the plate clamp, the pinching pressure between the tooth and lower jaw is released, thereby allowing the tooth to pivot inward, upward and away from the plate. The plate may thereafter be released from the plate clamp.

One drawback associated with the prior art plate clamps is that prior art plate clamps are typically moved with ropes or cables within a warehouse or other interior setting. The use of ropes or cables makes it difficult to utilize prior art plate camps outdoors, and to accurately control the movement of the plate clamp. Additionally, the use of ropes or cables in association with the plate clamp does not allow for pivoting of the plate clamp to allow the plate clamp to angle the plate upward as it is being moved.

An additional drawback associated with prior art plate clamps is that prior art plate clamps cannot be moved toward the plate without risking a loss of pressure on the plate and disengagement of the plate from the plate clamp. Similarly, the prior art plate clamp cannot be inverted, as gravity would force the plate into the mouth of the plate clamp, thereby releasing the pressure on the plate and allowing the plate to dislodge from the mouth of the plate clamp.

Still another problem associated with prior art plate clamps is the shallowness of the mouth associated with such clamps. It would be desirable to provide a plate clamp with a deeper mouth, allowing for securement of a wider range of materials within the mouth of the plate clamp. Yet another drawback associated with the prior art is the inability to easily disengage the plate clamp from a plate while the plate is raised. It would, therefore, be desirable to provide a material handling system which could be remotely actuated to secure a plate or other large piece of material and to move that piece of material to another position before release. It would also be desirable to provide such a material handling system with a deep mouth and secure mechanical engagement of a plate between a tooth and a lower jaw. It would be desirable to provide such a device the ability to secure the material even when the material handling system is moved toward the material, or the material is being forced by gravity deeper into the mouth of the material handling system.

It would be desirable to provide a material handling system which could be released from the material even when the material is being suspended downward and gravity is acting on the material in a direction outward from the mouth of the material handling system. It would also be desirable to provide such a material handling system on a vehicle mounted boom or other system for utilizing the material handling system outdoors and to position the material handling system at a plurality of heights and orientations as desired to move material.

In material handling situations, such as removing laminations from used electric transformers, prior art plate clamps are not maneuverable enough or precise enough to accurately and safely remove the sharp laminations from a transformer. Accordingly, this process must be accomplished by hand, exposing workers to dangerously sharp metal edges. It would, therefore, be desirable to provide a material handing system which could remotely handle hazardous materials, such as sharp edged metal plates, remotely with a smaller number of workers. The difficulties encountered in the prior art discussed hereinabove are substantially eliminated by the present invention, proving a safer material handling system utilizing a fewer number of workers.

SUMMARY OF THE INVENTION

In an advantage provided by this invention, a material handling system is provided which may be utilized to actively engage and move material.

Advantageously, this invention provides a material handling system which may be actuated to engage when the material handling system moves toward the material.

Advantageously, this invention provides a material handling system which may be actuated to release when the material is being drawn away from the material handling system.

Advantageously, this invention provides a material handling system which can engage material in a plurality of orientations.

Advantageously, this invention provides a material handling system which may be remotely actuated.

Advantageously, this invention provides a material handling system which may be mounted on a boom provided on a vehicle.

Advantageously, this invention provides a material handling system which safely handles hazardously sharp materials.

Advantageously, this invention provides a material handling system which reduces the number of workers to handle a particular material.

Advantageously, in a preferred example of this invention, a material handling system is provided with an upper jaw and a lower jaw defining an opening. A tooth is provided on the opening, as are means coupled to the tooth for moving the tooth within the opening. In the preferred embodiment, the tooth is coupled to a linear actuator which presses the tooth against material provided in the opening and against the lower jaw. The material handling system is coupled to a boom mounted on a vehicle to allow the material handling system to be oriented in any one of a plurality of desired orientations, and to move material from one location to another location.

BRIEF DESCRIPTION OF THE DRAWINGS

The present invention will now be described, by way of example, with reference to the accompanying drawings in which.

DETAILED DESCRIPTION OF THE PREFERRED EMBODIMENTS

Figure 1:
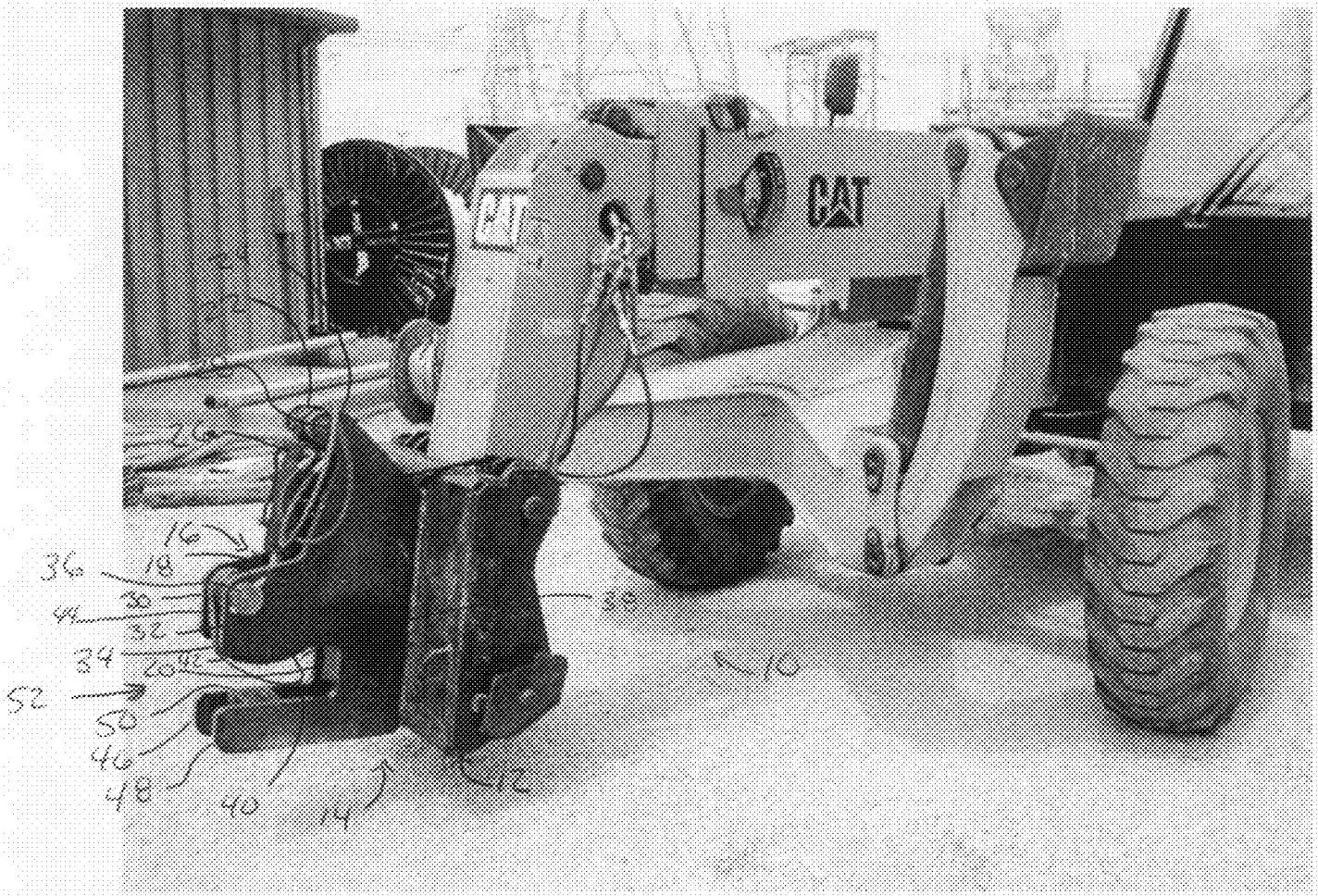
FIG. 1 illustrates a front perspective view of the material handling system of the present invention.

A material handling system according to this invention is shown generally as (10) in FIG. 1. As shown in FIG. 1, a base (12) is coupled to a material handler (14). The material handler (14) includes a first side plate (16) and second side plate (18) welded to the base (12). Provided between the first side plate (16) and second side plate (18) is a spacer (20). The first side plate (16) and second side plate (18) define a first piston tab (22) and second piston tab (24). Provided between the first piston tab (22) and second piston tab (24) is a hydraulic piston (26) journaled therein by a pin (28) secured to the first piston tab (22) and second piston tab (24). Alternatively, a pneumatic piston on a worm gear system may be utilized in place of the hydraulic piston (26). The first side plate (16) and second side plate (18) also define a first upper jaw plate (30) and second upper jaw plate (32). Journaled between the first upper jaw plate (30) and second upper jaw plate (32) is a tooth (34) journaled therein by a pin (36).

As shown by FIG. 1, the tooth (34) includes a straight back portion (38) extending to a rounded tip (40), then extending across a curved front (42). The tooth (34) also includes a flat top (44) connecting the curved front (42) to the straight back (38). While the tooth (34) may be of any desired configuration, at least a portion of the tooth (34) facing a first lower jaw (46) and second lower jaw (48) defined by the first side plate (16) and second side plate (18) is curved to provide the tooth (34) with a camming effect, and to allow the tooth (34) to engage material of varying thickness.

Welded between the first lower jaw (46) and second lower jaw (48) is a spacer (50). The first upper jaw plate (30), second upper jaw plate (32) and first lower jaw (46) and second lower jaw (48) define a mouth (52). While the mouth (52) may be of any desired length, in the preferred embodiment, the mouth (52) is twenty centimeters deep, more preferably thirty centimeters deep and, most preferably forty-seven centimeters deep. While the mouth (52) may be of any desired depth, the mouth (52) is preferably twice as deep as the distance between the first upper jaw plate (30) and first lower jaw (46) and, more preferably, at least three times the distance between the upper jaw plate (30) and first lower jaw (46).

Figure 2:
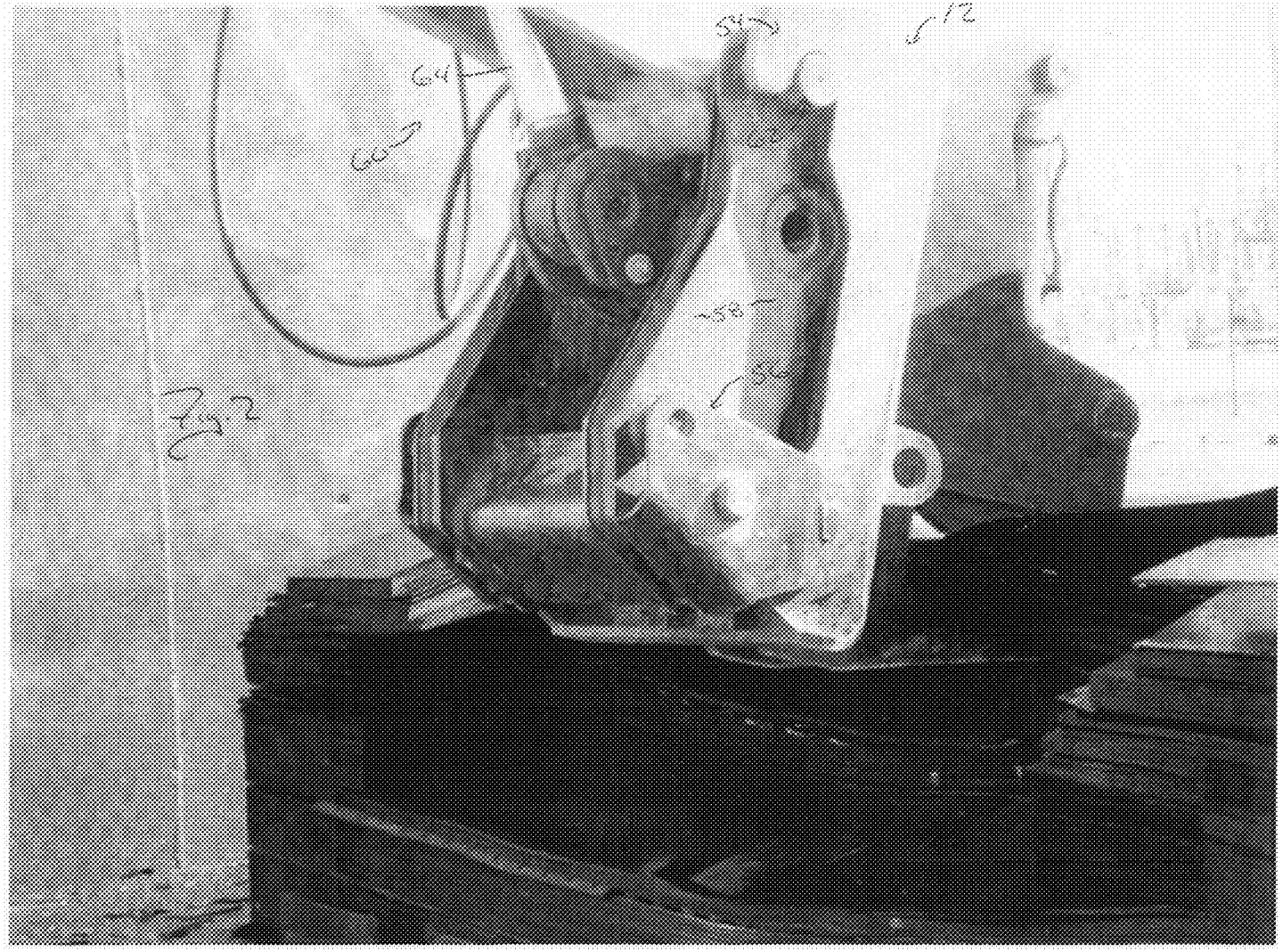
FIG. 2 illustrates a rear perspective view of the material handling system of the present invention.

As shown in FIG. 2, the base (12) is provided with a pair of hooks (54) and a lock (56) to engage the base (12) with head (58) of a boom (60), such as that known in the art. As shown in FIG. 2, the set of hooks (54) engage over a set of pins (62) provided on the head (58) of the boom (60) in a manner such as that known in the art for engagement with a plurality of standard implements. The lock (56) engages and secures the head (58) to prevent inadvertent dislodgement of the base (12) from the head (58) of the boom (60). As shown in FIG. 2, a linear actuator, such as a hydraulic piston (64) is secured between the boom (60) and head (58) to allow mechanical pivoting of the head (58) relative to the boom (60).

Figure 3:
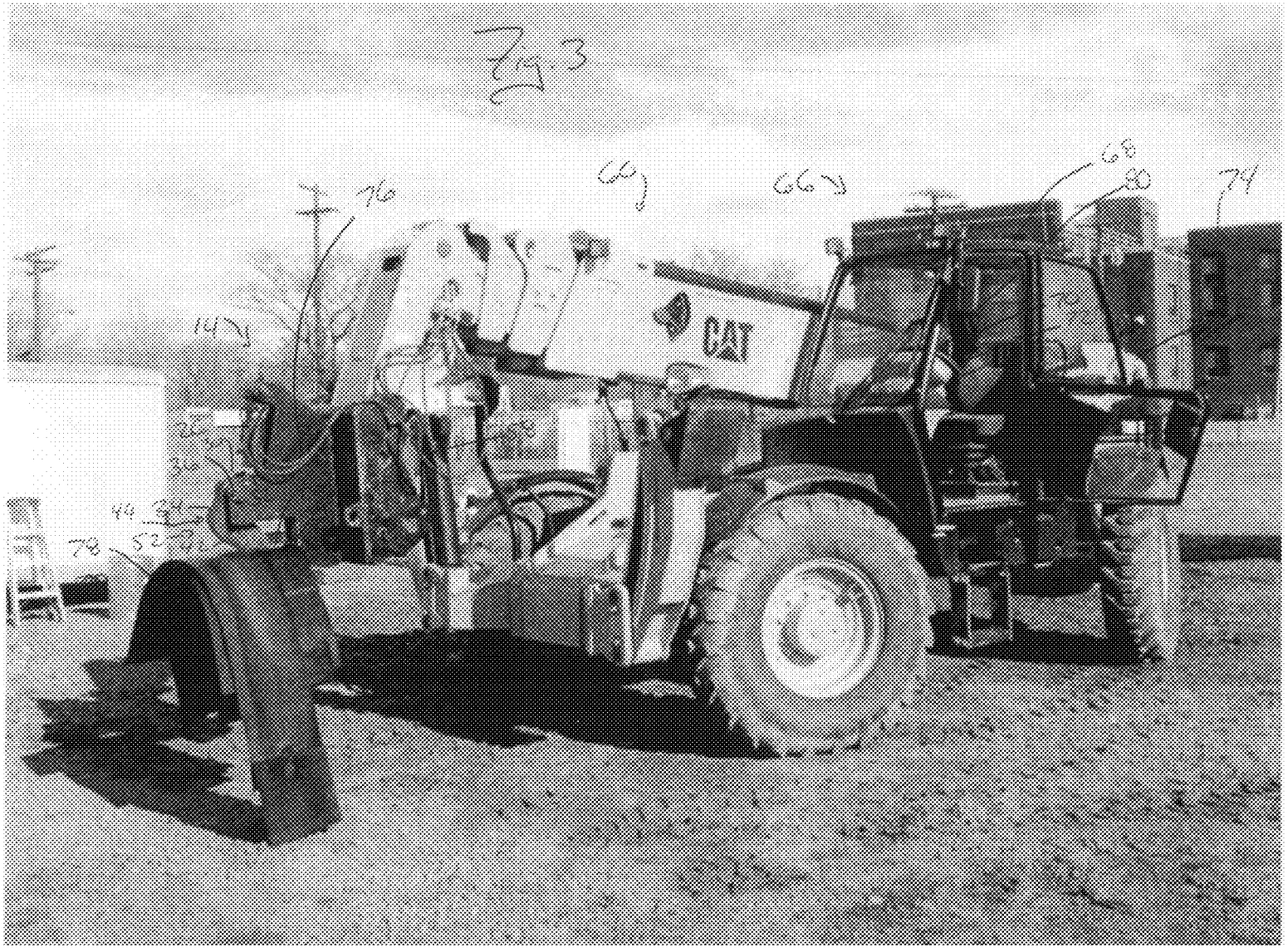
FIG. 3 illustrates a front perspective view of the material handling system of the present invention engaged with and moving laminations from a transformer.
Figure 1:
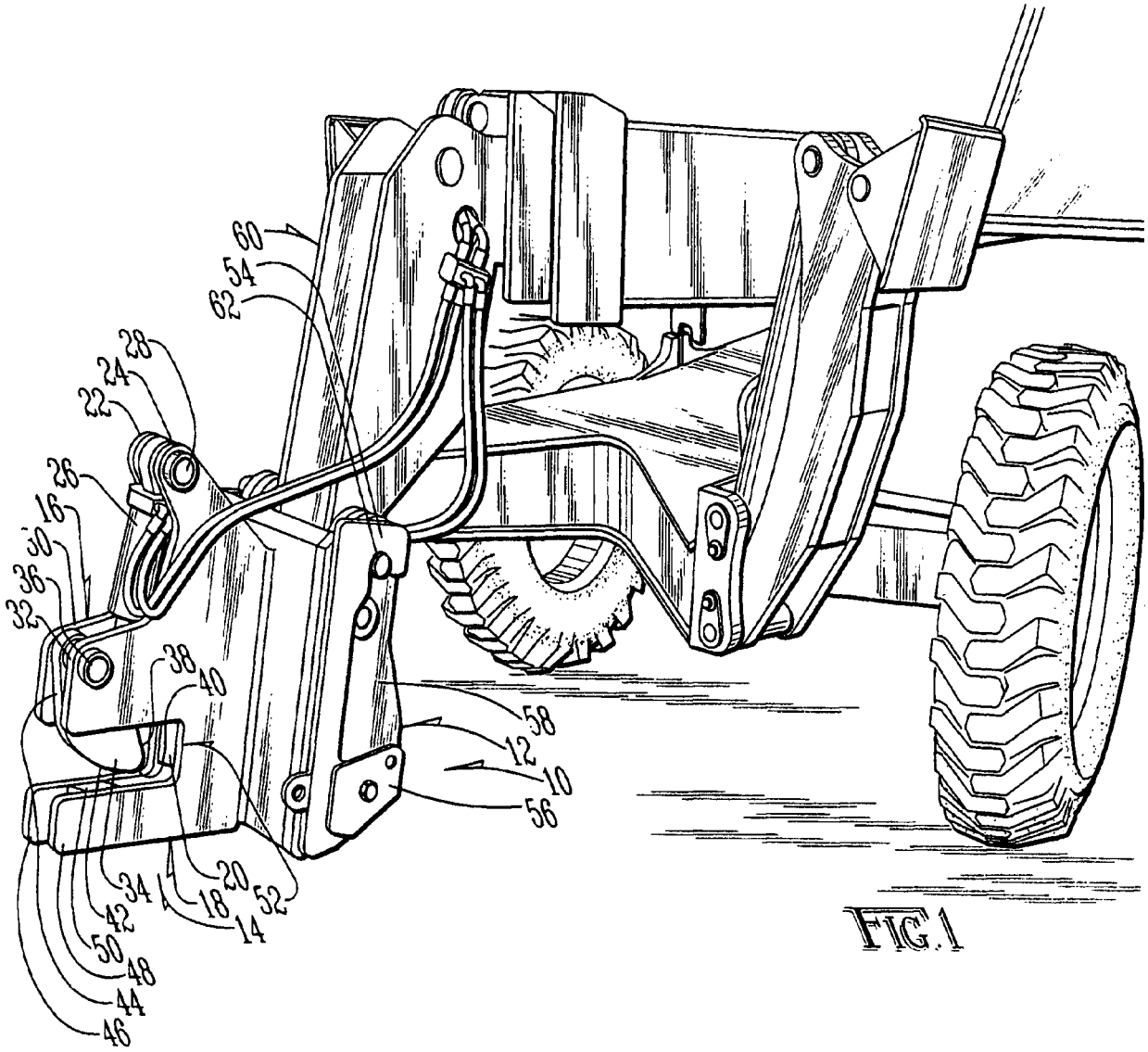
Figure 2:
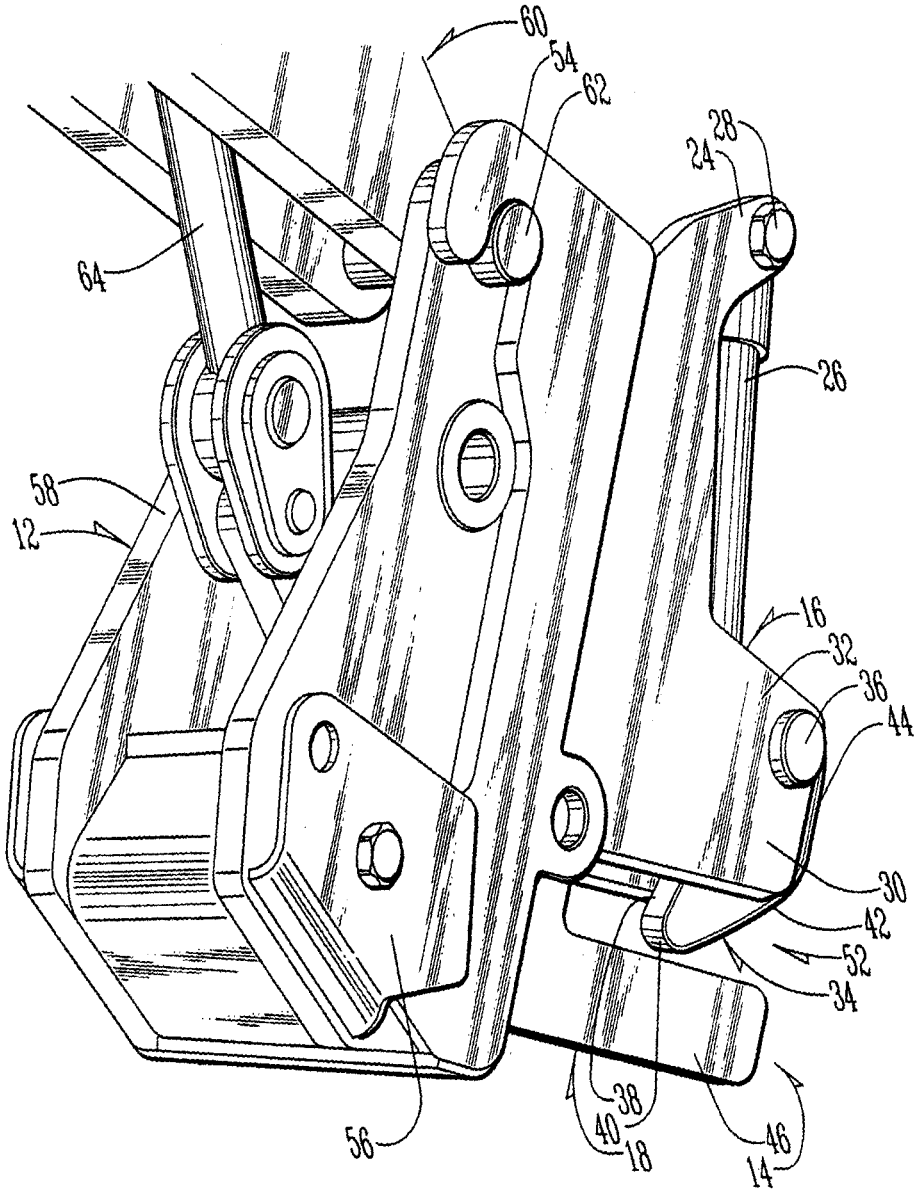
Figure 3:
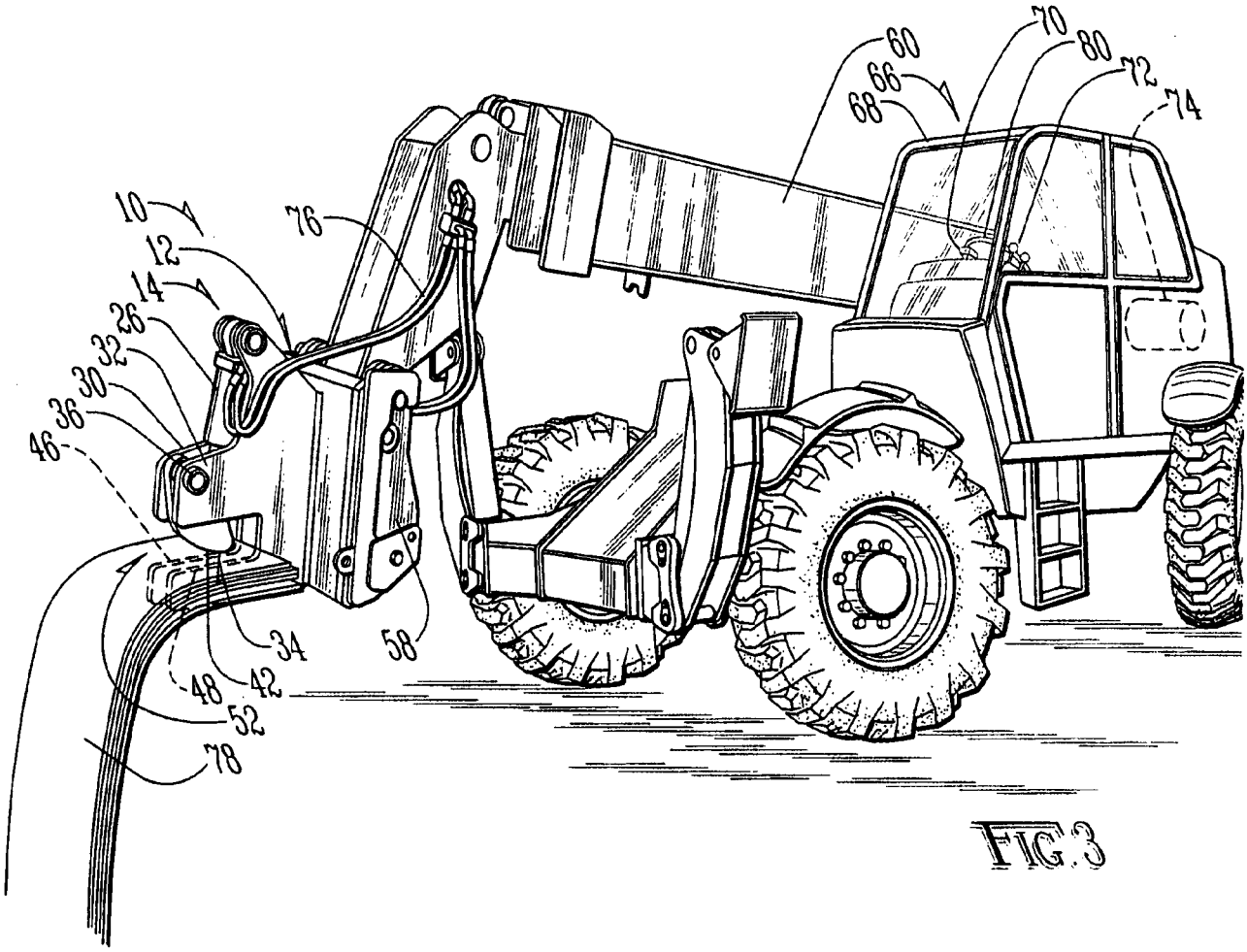

As shown in FIG. 3, the boom (60) is secured to a vehicle (66). The vehicle (66) is provided with a cab (68) within which is provided a joystick (70). In addition to the standard controls (72), such as those known in the art for controlling the boom (60) and head (58), the joystick (70) is coupled to a linear actuator motor (74), such as a hydraulic pump, coupled to a hydraulic line (76) which, in turn, are coupled to the hydraulic piston (26). Accordingly, movement of the joystick (70) causes the hydraulic piston (26) to move the tooth (34) within the mouth (52) of the material handler (14).

When it is desired to recycle laminations (78), a transformer (79) is dismantled enough to expose the laminations (FIG. 3). In the preferred embodiment, the transformer is at least 1 MVA and the laminations (78) weigh at least one hundred kilograms, and more preferably, at least two hundred fifty kilograms, but the material handling system (10) may be used to recycle laminations (78) of any desired weight from any desired size transformer (79).

Figure 4:
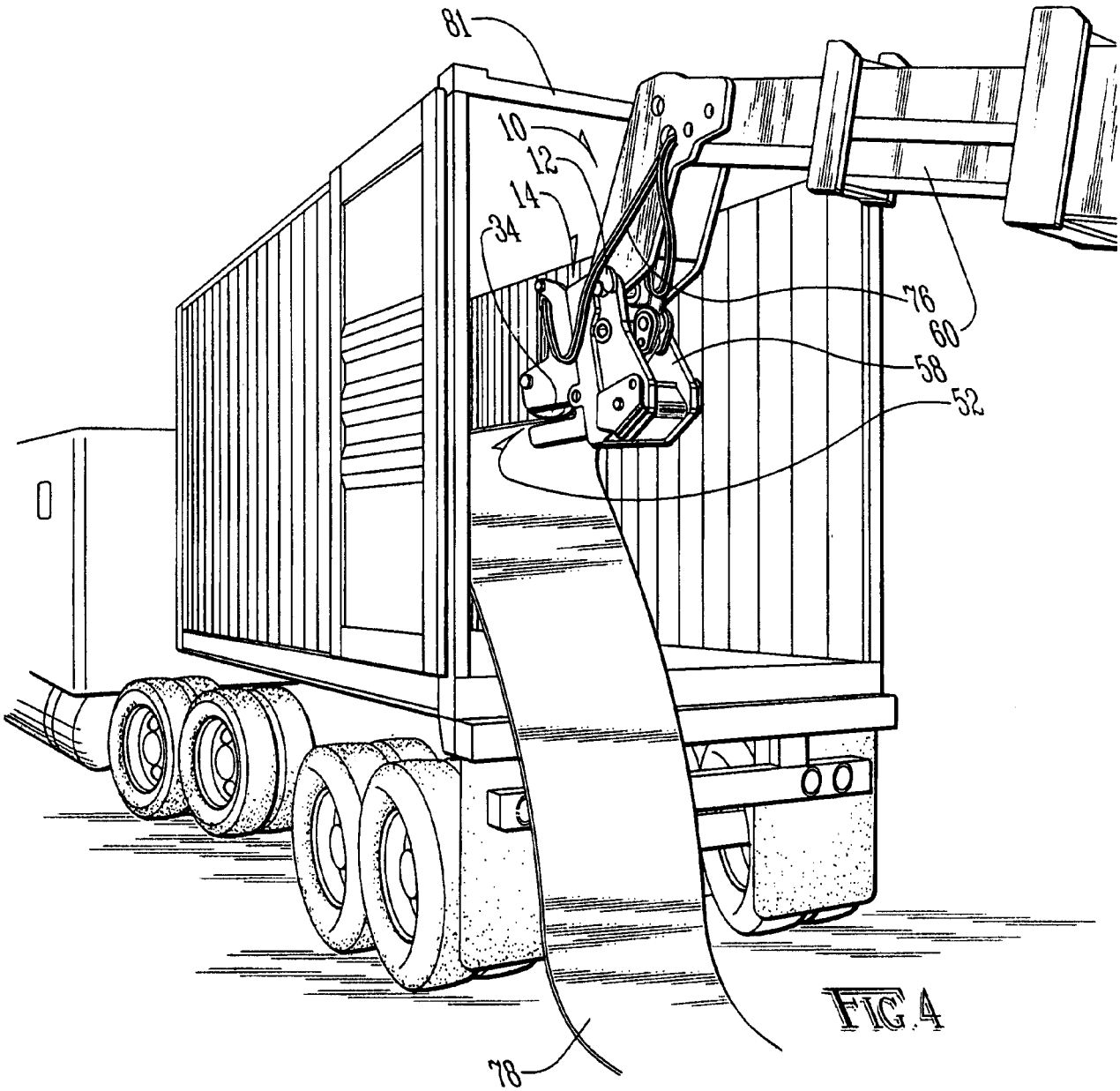
FIG. 4 illustrates a rear perspective view of the material handling system of the present invention loading laminations into a transport vehicle.

Once the laminations (78) have been exposed, the operator actuates the controls (72) to move the boom (60) and head (58) into the desired position, and to position the mouth (52) of the material handler (14) around the laminations (78). Thereafter, the operator actuates the joystick (70) to cause the hydraulic piston (26) to rotate the tooth (34) to engage the laminations (78) between the curved front (42) of the tooth (34) and the lower jaws (46) and (48). As shown in FIG. 3, it is desirable to configure the tooth (34) so that the portion of the tooth (34) engaging the laminations (78) is rearward of the pin (36) securing the tooth (34) to the first upper jaw plate (30) and second upper jaw plate (32). Accordingly, gravity or other force tending to pull the laminations from the mouth (52) of the material handler (14) simply pulls the tooth (34) into tighter engagement with the laminations (78). After the laminations (78) have been engaged, the operator utilizes the vehicle controls (80) to move the vehicle (66) and laminations (78) to a transport vehicle (81). (FIGS. 3-4). It is desirable to remove the laminations (78) from the transformer (79) and insert them into the transport vehicle (81) with a minimum of damage to the laminations (78).

Thereafter, the operator utilizes the controls (72) to position the boom (60) and head (58) in the desired position for release of the laminations (78). (FIGS. 3-4). The operator actuates the joystick (70) to release the laminations (78) onto the transport vehicle (81). By providing the material handler (14) with a deep mouth (52) and a hydraulic piston (26), very heavy laminations (78) may be securely engaged by the material handler (14) and safely moved without the dangers associated with manual contact with the sharp metal edges of the laminations (78), and without additional workers required for manual handling and transport of the laminations (78) in accordance with the processes of the prior art.

Figure 5:
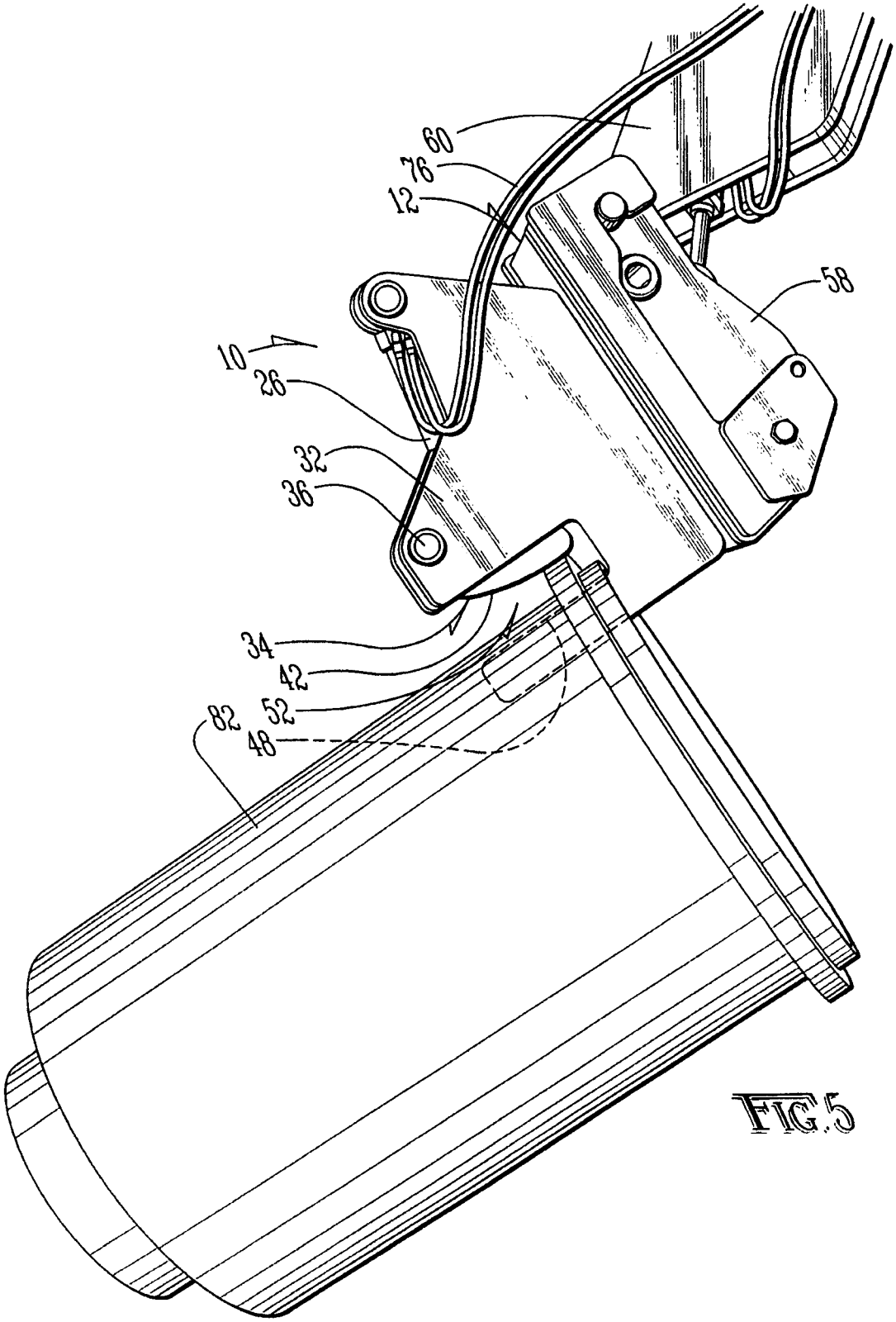
FIG. 5 illustrates a front elevation of the material handling system engaged with and moving bulk materials.

As shown in FIG. 5, if it is desirable to move larger or bulkier materials or to dump containers, such as a breaker barrel (82), the operator utilizes the vehicle controls (80) to move the vehicle (66) into position near the breaker barrel (82) and then utilizes the controls (72) to position the boom (60) and head (58) so that a portion of the breaker barrel (82) is positioned within the mouth (52) of the material handler (14). Thereafter, the operator actuates the joystick (70) to cause the hydraulic piston (26) to clamp the tooth (34) into engagement with the breaker barrel (82) against the first lower jaw (46) and second lower jaw (48). Although the portion of the breaker barrel (82) gripped by the material handler (14) is much thicker than the laminations (78) discussed above, the curved front (42) of the tooth (34) allows the material handler (14) to securely grip the breaker barrel (82) in a similar manner.

After the breaker barrel (82) has been secured by the material handler (14), the operator actuates the controls (72) to lift the boom (60) and head (58) as desired for transport of the breaker barrel (82). Thereafter, the operator may operate the vehicle controls (80) to move the breaker barrel (82) to another desired location, whereafter the operator may utilize the controls (72) and joystick (70) to dump the breaker barrel (82) before returning it. As shown in FIG. 5, the active engagement of the tooth (34) by the hydraulic piston (26) allows the material handler to release the breaker barrel (82) even when gravity is acting on the breaker barrel (82) to pull the tooth (34) into tighter engagement with the breaker barrel (82). Similarly, even when the breaker barrel (82) is being forced further into the mouth (52) of the material handler (14), such as would be the case if the operator were to actuate the controls (72) to lift the breaker barrel (82) above the mouth (52) of the material handler (14). The operator may use the joystick (70) to actuate the hydraulic piston (26) to cause the tooth (34) to maintain secure engagement with the breaker barrel (82).

The foregoing description and drawings merely describe and illustrate the invention, and the invention is not limited thereto, except insofar as the claims are so limited, that those skilled in the art that have the disclosure before them will be able to make modifications and variations therein without departing from the scope of the invention. For example, the material handling system (10) may be used to transport any desired material and may be constructed of any suitable material in any suitable dimensions, and any suitable configuration. The mouth (52) may be defined by a solid piece of metal rather than a first side plate (16) and second side plate (18) if desired. Additionally, a supplemental tooth may be secured to the first lower jaw (46) and second lower jaw (48) to provide a dual tooth engagement with material provided within the mouth (52) of the material handler (14). Additionally, it is contemplated that the material handler (14) may be utilized in association with cables or ropes, or any other suitable means for moving the material handler (14) into and out of engagement with material.

What is claimed is:

1. A material handling system comprising:
(a) an upper jaw;
(b) a lower jaw coupled to said upper jaw, wherein said upper jaw and said lower jaw define an interior having a forward facing opening;
(c) a tooth coupled to said upper jaw at a journal point, said tooth comprising:
(i) a material handling contact face;
(ii) a non-contact face; and
(iii) a tip;
(d) a linear actuator coupled to said tooth in a configuration where said tip of said tooth is located rearward of said journal point, and
(e) a linear actuator motor coupled to the linear actuator.

2. The material handling system of claim 1, wherein said opening has a depth greater than a distance between said upper jaw and said lower jaw.

3. The material handling system of claim 2, wherein said linear actuator is a hydraulic cylinder.

4. The material handling system of claim 3, wherein said tooth is provided with a tip and wherein said hydraulic cylinder is coupled to said tooth between said tip and said journal point.

5. The material handling system of claim 1, wherein said upper jaw comprises a first plate and a second plate.

6. The material handling system of claim 5, wherein said tooth is provided between said first plate and said second plate.

7. The material handling system of claim 6, wherein said lower jaw comprises a portion of said first plate and a portion of said second plate.

8. The material handling system of claim 5, wherein said linear actuator is located between said first plate and said second plate.

9. The material handling system of claim 1, further comprising a boom coupled to said upper jaw.

10. The material handling system of claim 1, wherein said opening is at least twenty centimeters deep.

11. The material handling system of claim 9, further comprising a vehicle coupled to said boom.

12. A material handling system comprising:
(a) a boom;
(b) an upper jaw coupled to said boom;
(c) a linear actuator coupled to said boom and said upper jaw;
(d) a lower jaw coupled to said upper jaw, wherein said upper jaw and said lower jaw define an opening;
(e) a tooth coupled to the upper jaw at a journal point, said tooth comprising:
(i) a material handling contact face;
(ii) a non-contact face; and
(iii) a tip;
(f) a linear actuator coupled to said tooth in a configuration where said tip of said tooth is located closer to said boom than said journal point, and
(g) a linear actuator motor coupled to the linear actuator.

13. A method for removing material from a core of a transformer comprising:
(a) providing a transformer having material contained at least partially therein;
(b) providing a material handling system comprising:
(i) an upper jaw;
(ii) a lower jaw coupled to said upper jaw, wherein said upper jaw and said lower jaw define an interior, having a forward facing opening;
(iii) a tooth coupled to said upper jaw at a journal point, said tooth comprising:
(a) a material handling contact face;
(b) a non-contact face; and
(c) a tip;
(iv) a linear actuator coupled to said tooth;
(c) providing at least a portion of said material within said opening; and
(d) actuating said linear actuator to move said tooth until said material is retained between said material handling contact face of said tooth and said lower jaw at a point rearward of said journal point.

14. The method for removing material from a core of a transformer of claim 13, wherein said transformer is at least one megavolt-ampere.

15. The method for removing material from a core of a transformer of claim 13, wherein said material is a lamination in excess of one hundred kilograms.

* * * * *

UNITED STATES PATENT AND TRADEMARK OFFICE

CERTIFICATE OF CORRECTION

PATENT NO. : 7,967,548 B2
APPLICATION NO. : 11/818230
DATED : June 28, 2011
INVENTOR(S) : Stroh It is certified that error appears in the above-identified patent and that said Letters Patent is hereby corrected as shown below:

Please delete the title page showing an illustrative figure should be deleted and substitute therefor the attached title page Delete drawing sheet 1 of 5 and insert drawing sheet 1 of 5 consisting figures 1-5 as attached Signed and Sealed this
Sixteenth Day of August, 2011

David J. Kappos

David J. Kappos
*Director of the United States Patent and Trademark Office*

(12) United States Patent
Stroh

(10) Patent No.: US 7,967,548 B2
(45) Date of Patent: Jun. 28, 2011

(54) MATERIAL HANDLING SYSTEM

(75) Inventor: Brad Stroh, Waterloo, IA (US)

(73) Assignee: A-Line EDS, Inc., Waterloo, IA (US)

( * ) Notice: Subject to any disclaimer, the term of this patent is extended or adjusted under 35 U.S.C. 154(b) by 288 days.

(21) Appl. No.: 11/818,230

(22) Filed: Jun. 13, 2007

(65) Prior Publication Data

US 2008/0310942 A1 Dec. 18, 2008

(51) Int. Cl.
*B66C 1/00* (2006.01)

(52) U.S. Cl. ..... 414/729; 294/104; 29/700

(58) Field of Classification Search ..... 414/729; 294/104; 29/700, 711, DIG. 47
See application file for complete search history.

(56) References Cited

U.S. PATENT DOCUMENTS 3,097,011 A * 7/1963 Foster ..... 294/104
4,162,804 A * 7/1979 Davies ..... 294/101
4,187,711 A * 2/1980 Lavochkin et al. ..... 72/256
4,969,780 A * 11/1990 Hermsted ..... 408/1 R
6,086,126 A * 7/2000 Krauss ..... 294/104
7,329,082 B2 * 2/2008 Warren ..... 414/723

* cited by examiner

*Primary Examiner* -- Donald Underwood
(74) *Attorney, Agent, or Firm* -- Brett Trout

(57) ABSTRACT

A material handling system for engaging and transporting material. The material handling system includes a mouth and a hydraulic actuator for pivoting a tooth within the mouth. Once a material has been positioned within the mouth, the hydraulic piston actuates the tooth to secure the material within the mouth. The tooth is preferably configured and oriented to move into tighter engagement with the material as gravity or other forces attempt to remove the material from the mouth. The hydraulic piston allows an operator to release the tooth whenever desired. The material handling system includes a vehicle mounted boom coupled to the mouth so that material engaged by the mouth may be transported to another desired location.

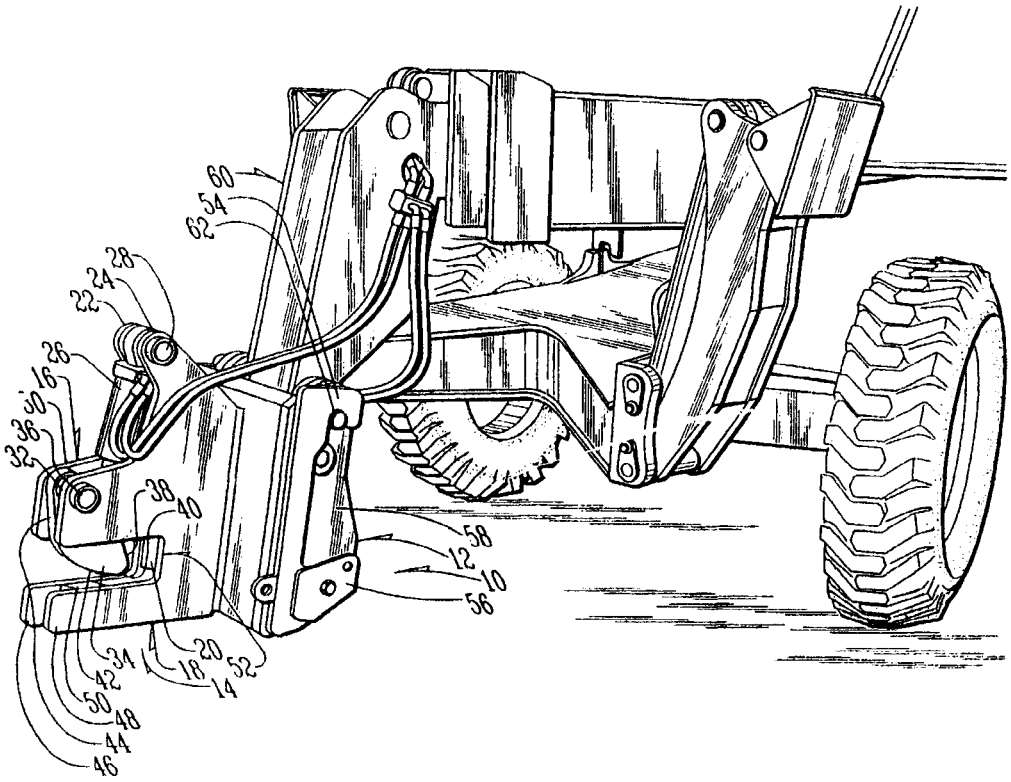

15 Claims, 5 Drawing Sheets